US005720659A

United States Patent [19]

Wicks

[11] Patent Number: 5,720,659

[45] Date of Patent: Feb. 24, 1998

[54] FIRE PROTECTION SYSTEM AND METHOD USING DUAL-PURPOSE PLUMBING

[76] Inventor: Edward A. Wicks, 11 W. Redding Rd., Danbury, Conn. 06810

[21] Appl. No.: 760,279

[22] Filed: Dec. 4, 1996

[51] Int. Cl.[6] ..... F24F 11/00

[52] U.S. Cl. ..... 454/256

[58] Field of Search ..... 454/256, 258; 169/16, 48, 54, 56; 128/200.24, 204.18, 205.25, 202.13

[56] References Cited

U.S. PATENT DOCUMENTS

| | | | |
|---|---|---|---|
| 4,380,187 | 4/1983 | Wicks . | |
| 4,467,796 | 8/1984 | Beagley | 128/205.25 X |
| 4,928,583 | 5/1990 | Taylor et al. | 454/256 |

*Primary Examiner*—Harold Joyce
*Attorney, Agent, or Firm*—Robert J. Harter

[57] ABSTRACT

A fire protection system and method supplies life-sustaining air to occupants taking refuge in the bathrooms of a building. Upon sensing a fire, the system automatically drains water from the building's hot water re-circulating loop. The loop drains rapidly due to the loop's automatic vent valve and re-circulating pump. Fresh air selected from among number of sources is then injected into the loop at a rather low pressure. The low pressure actuates a low pressure relief valve located at each bathroom sink. The valves automatically release the fresh air into each bathroom. If there is any exhaust vent in any of the bathrooms, it is equipped with an automatic damper that seals in the fresh air and prevents a back draft of smoke.

19 Claims, 4 Drawing Sheets

FIRE PROTECTION SYSTEM AND METHOD USING DUAL-PURPOSE PLUMBING

BACKGROUND OF THE INVENTION

1. Field Of The Invention

The subject invention generally pertains to fire safety within a building, and more specifically to a method of using a building's existing plumbing to supply life-sustaining air to any occupants.

2. Description Of Related Art

Fires in high-rise, multiple dwelling structures, such as apartment buildings, hotels, motels and office buildings, are a serious source of concern to people who either live in or temporarily reside in such premises. Fires with the resultant intense smoke and fume generation are particularly devastating in high-rise structures in which a large number of people may be entrapped. Furthermore, by their very nature, high-rise structures present physical impediments to rapid rescue attempts, particularly with regard to persons who may be entrapped on the upper levels of such structures. Accordingly, the time elapsing between the initial outbreak of a fire and the arrival of the rescue team at a room on an upper floor may be relatively great.

Most fire related deaths are not caused by the fire directly, but result from the toxic fumes and smoke generated by the fire. A common procedure for entrapped persons, whose escape has been blocked or the route is unknown, is to await rescue by isolating themselves as much as possible from the fumes and smoke of the fire. This isolation is generally attempted by huddling within a small room (e.g., the bathroom) with the door closed, and for example, by placing wet materials against the bottom of the door and the floor to prevent fumes and smoke from entering. The difficulty resulting from this procedure is that there is only a limited amount of breathable air within the isolated room, and there may be no means for providing fresh air. (For example, there may be no windows in the bathroom or the smoke rising around the building from lower floors may dictate that the bathroom window must remain closed.) In spite of the barricading efforts by those who are trapped, smoke and fumes quickly begin seeping into the place of refuge, and thus asphyxiation or smoke poisoning may soon result unless rescuers arrive almost immediately.

One system disclosed in Edward Wicks' U.S. Pat. No. 4,380,187 (specifically incorporated by reference herein), uses a building's existing plumbing to supply life-sustaining air to the bathrooms. However, the system does not provide a means for rapidly and forcibly draining the water from the line. Thus, the supply of fresh air is delayed.

In addition, with the original Wicks System, the air is delivered at a relatively high pressure above the normal water pressure. Simple pressure relief valves automatically open to release the air whenever exposed to this higher pressure. Consequently, the valves also open to release water in response to unexpected surges in water pressure or water entrapped by incoming high pressure air.

Another shortcoming includes the lack of a clear indication as to whether the system has been activated as well as a lack of a means for sealing off a bathroom vent. An open vent can exhaust the limited supply of fresh air, or worse yet, convey smoke into the bathroom.

To overcome these problems, it is an object of the present invention to deliver fresh air at a pressure below the normal water pressure.

A second object is to employ the pumping action of a hot water re-circulation loop to forcibly drain the water. This rapidly opens a line for the fresh air.

A third object is to provide an air/water relief valve that remains shut when exposed to high pressure surges.

A fourth object is to provide the fresh air delivery line with a whistle that clearly indicates when the system is activated should the occupants be sleeping.

A fifth object is to provide the hot water re-circulation loop with a vent at an uppermost point to facilitate rapid draining of the loop.

A sixth object is to use the hot water line for air while maintaining the cold water line's supply of water for the purpose of drinking or filling a bath tub.

A seventh object is to couple the air/water relief valve to the drain trap to provide draining of any water.

An eighth object is to provide a bathroom vent that closes automatically to contain the supply of fresh air and seal out smoke.

A ninth object is to provide multiple sources of fresh air to automatically choose from in case one supply is contaminated by smoke.

These and other objects of the invention are provided by a novel fire-safe building system and method that includes forcibly draining and venting a hot water re-circulating loop and automatically delivering fresh air through the loop and on to the bathrooms. The air is delivered at a pressure below a minimum water pressure.

DESCRIPTION OF THE PREFERRED EMBODIMENT

Figure 1:
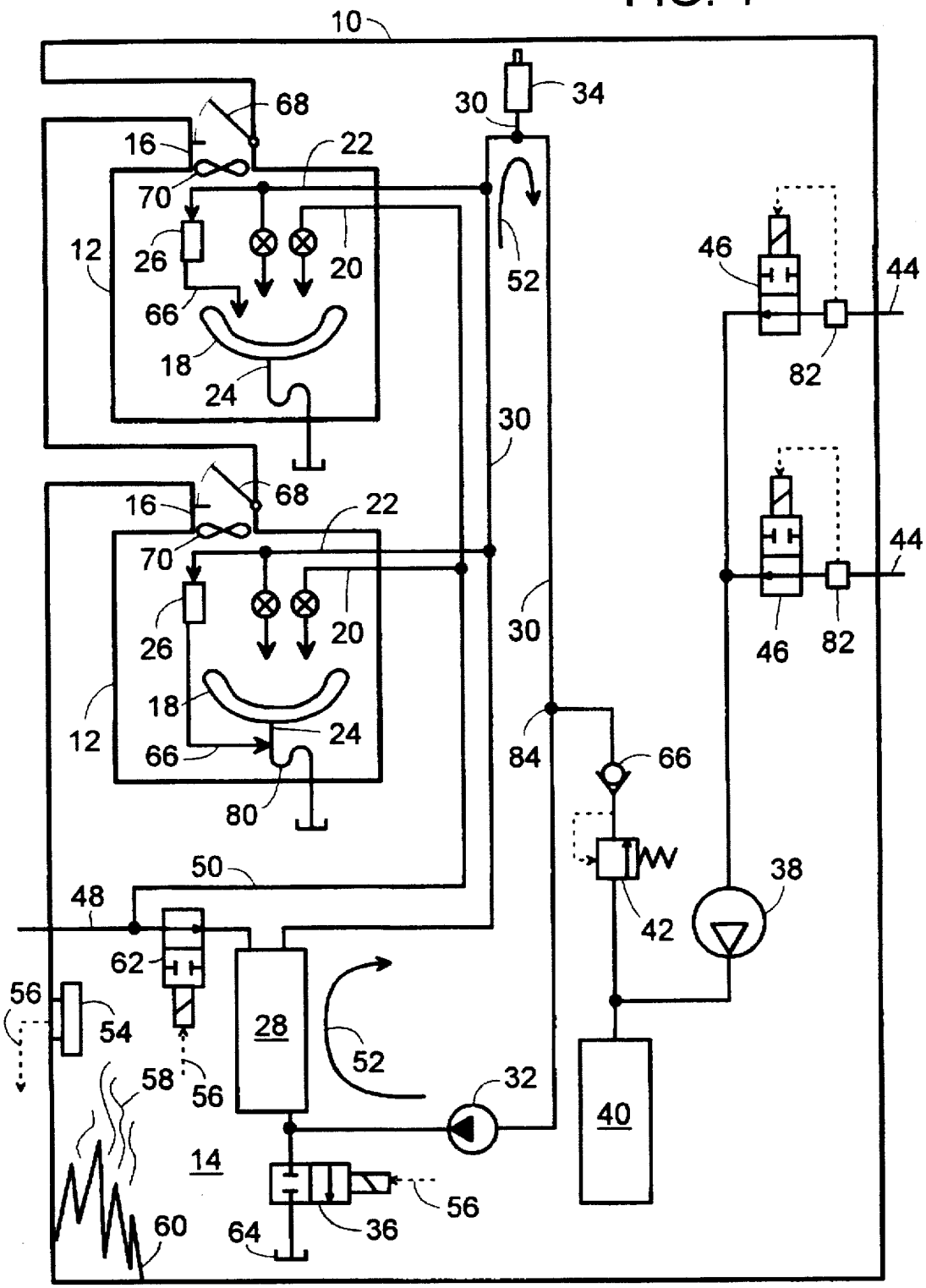
FIG. 1 is a schematic diagram of the invention showing a fire-safe building system employing a method of conveying low pressure air through a hot water re-circulating loop.

Referring to FIG. 1, a building 10 includes several bathrooms 12 and another room 14. Each bathroom 12 includes a sink 18 and also a pressure actuated room air exhaust vent 16 exhausting to atmosphere. Each sink 18 has a cold water supply line 20, a hot water supply line 22, a sink drain 24, and a pressure sensitive valve 26. Building 10 also includes a water heater 28, a hot water supply loop 30 with a circulating pump 32, a vent valve 34, a drain valve 36, an air compressor 38, an air tank 40, an air pressure regulator 42, and two supply air sources 44 that selectively feed compressor 38 by way of air supply valves 46.

Under normal operation, a water main 48 supplies water to a cold water line 50 which feeds supply lines 20. Water main 48 also supplies water heater 28 which discharges heated water to hot water supply loop 30 which in turn feeds hot water supply lines 22 at each bathroom sink 18. A predetermined desired minimum water pressure in hot water supply lines 22 is 5 to 8 psi. Pump 32 serves to keep heated water in a re-circulating flow pattern 52 around loop 30 and through heater 28. The re-circulation keeps the heated water in loop 30 from becoming undesirably cool.

In the event of a fire, a sensor 54 provides an electrical signal 56 in response to detecting heat 58 indicative of a fire 60. It should be appreciated, however, that sensor 54 represents any one of a variety of widely available fire detectors responsive to any one of a variety of characteristics indicative of a fire such as smoke, heat 58, or ionized particles. Signal 56 opens drain valve 36 and closes a hot water shutoff valve 62. With the help of vent 34 and pump 32, the heated water in loop 30 rapidly drains out through drain valve 36 to a drain 64.

Air from compressor 38 and tank 40 is then injected into loop 30 through a check valve 66 after reducing the air pressure to approximately 3 psi by pressure regulator 42. With the 3 psi fluid pressure value being less than the predetermined minimum water pressure value of 5 to 8 psi, each pressure sensitive valve 26 opens. This allows relatively low pressure air to enter each bathroom 12. The flow rate of air 66 is high enough to supply the breathing needs of people in the bathroom, yet is designed to be low enough to keep a damper 68 of exhaust vent 16 from blowing open. (In normal operation with no fire, a fan 70, of vent 16, generates enough airflow to open damper 68.)

Figure 2:
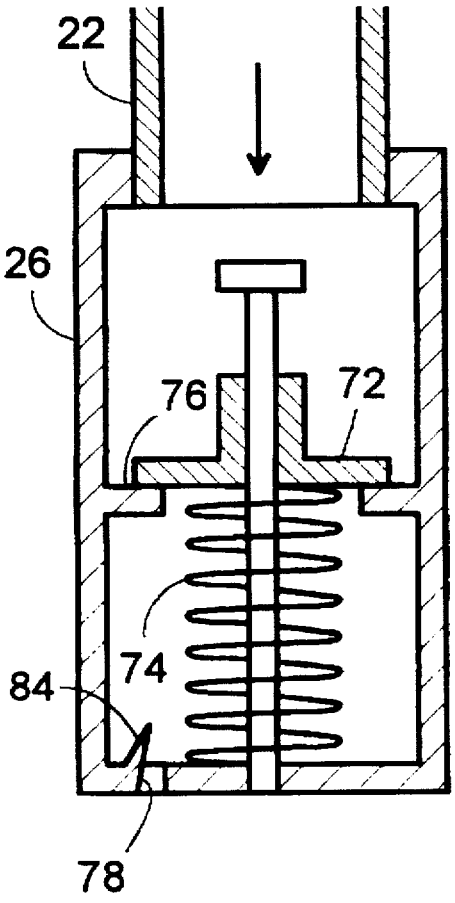
FIG. 2 is a schematic diagram of a pressure sensitive valve in a closed position.
Figure 3:
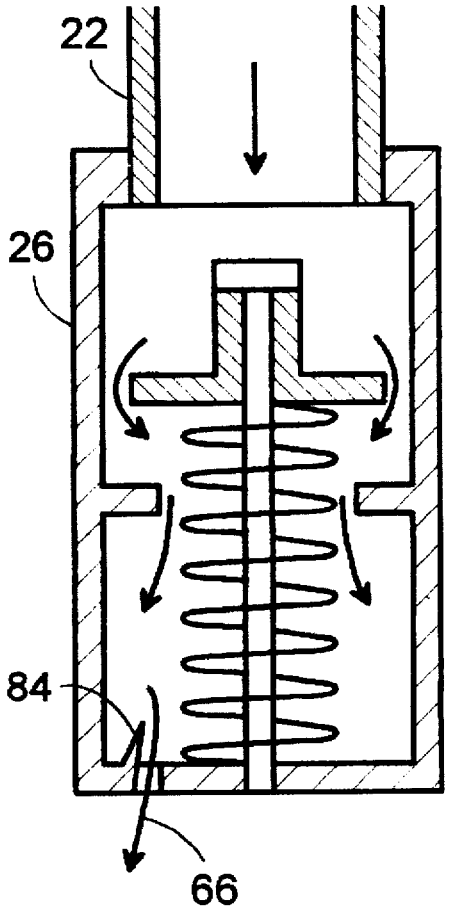
FIG. 3 is a schematic diagram of a pressure sensitive valve in an open position.

The operation of pressure sensitive valve 26 is more clearly understood with reference to FIGS. 2 and 3. In FIG. 2, valve 26 is closed when the fluid pressure in hot water supply line 22 is above a predetermined minimum pressure. This pressure exerts enough force against a plug 72 to overcome a compression spring 74 and hold plug 72 against a valve seat 76. When the pressure line 22 drops sufficiently, spring 74 overcomes the pressure and pushes plug 72 away from seat 76, as shown in FIG. 3. This allows low pressure fluid to pass from line 22 and into room 12 through orifice 78. In one embodiment of the invention, orifice 78 is connected to a sink drain 24 just above a trap 80 (FIG. 1). In another embodiment, valve 26 includes a whistle 84 that produces a whistling sound (i.e., sound generated by airflow) indicating that valve 26 is open.

To ensure compressor 38 draws fresh air, air supply valves 46 include air quality monitors 82 that select the freshest air source and opens and shuts valves 46 accordingly. One example of quality monitor 82 is a smoke or CO carbon monoxide) detector.

Figure 4:
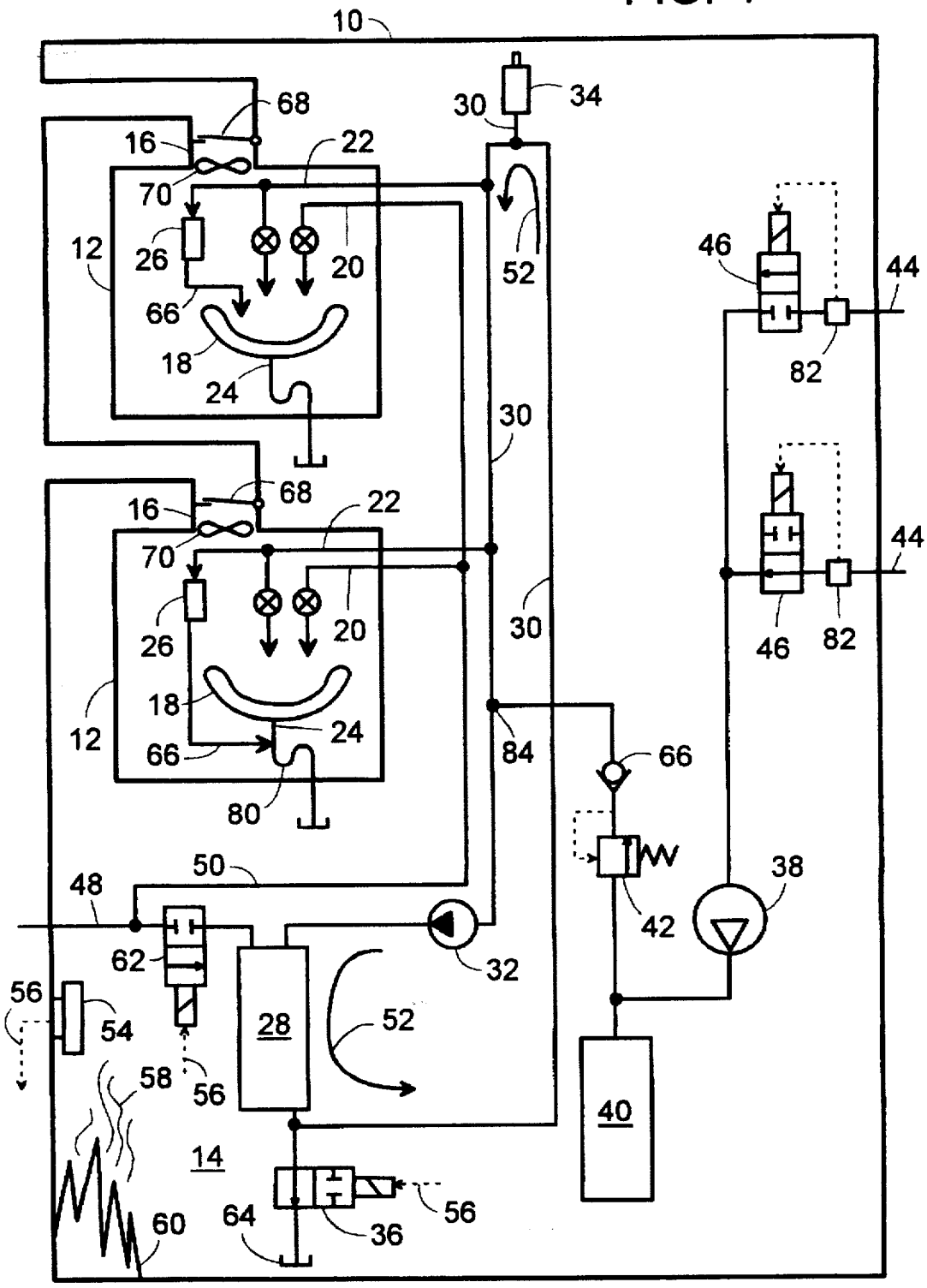
FIG. 4 is a schematic diagram showing another embodiment of the invention.

FIG. 4 illustrates another embodiment of the invention where pump 32 and an air injection point 84 are relocated. Although this changes the direction of some of the fluid flow paths, this system functions fundamentally the same as that of FIG. 1. In FIG. 4, valves 36, 62 and dampers 68 are shown in the position they would assume during a fire.

Figure 5:
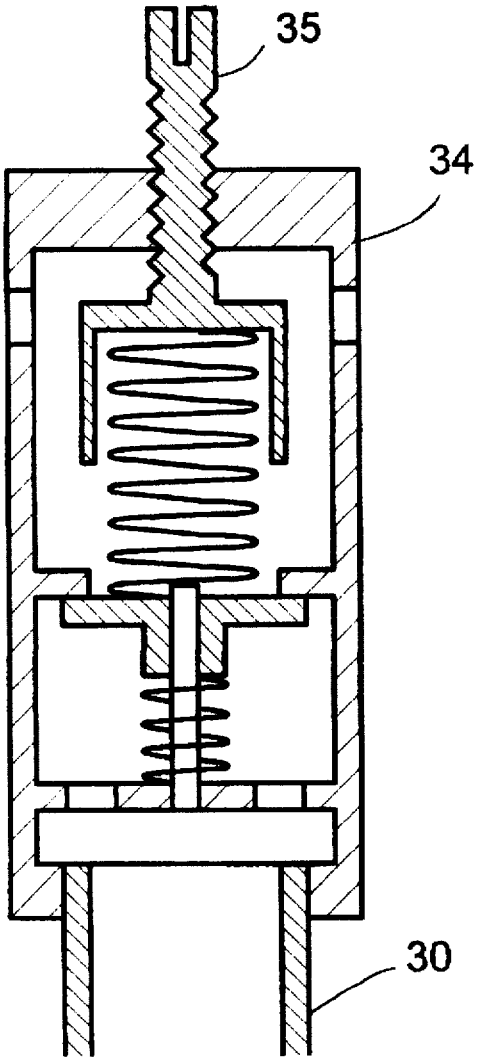
FIG. 5 is a schematic diagram of a vent valve in a closed position.
Figure 6:
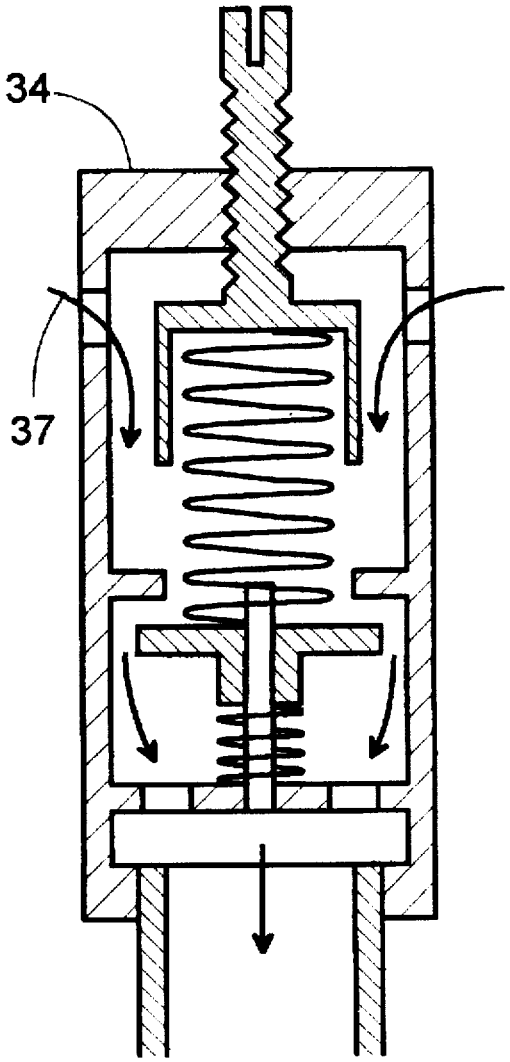
FIG. 6 is a schematic diagram of a vent valve in an open position.

Referring to FIGS. 5 and 6, vent valve 34 serves as a low pressure or vacuum break that allows air 37 to be drawn into loop 30 while loop 30 is draining through drain valve 36. Valve 34 is shown in a closed position in FIG. 5 and in an open position FIG. 6. Valve 34 opens in response to fluid pressure in loop 30 dropping below a second predetermined minimum. The predetermined minimum pressure is set below 3 psi by adjusting screw 35. If desired, screw 35 can be adjusted so a vacuum in loop 30 is required to open valve 34.

It should be noted that the term "hot water" used herein refers to water that has been heated and is not limited to water above any particular temperature.

Although the invention is described with respect to a preferred embodiment, modifications thereto will be apparent to those skilled in the art. Therefore, the scope of the invention is to be determined by reference to the claims which follow.

I claim:

1. A method of conveying a supply of air to a plurality of rooms upon the presence of a sign of fire, said plurality of rooms each being supplied with heated water above a predetermined minimum water pressure via a corresponding plurality of hot water supply lines that are interconnected by a common hot water supply loop, said method comprising the steps of:

pumping said heated water in a re-circulating flow pattern through said common hot water supply loop;

sensing said sign of fire;

upon sensing said sign of fire, draining said heated water from said common hot water supply loop, said step of draining being initially assisted by said step of pumping;

injecting said supply of air into said common hot water supply loop; and conveying said supply of air from said common hot water supply loop and into said plurality of rooms via said corresponding plurality of hot water supply lines, said supply of air in said corresponding plurality of hot water supply line being at a delivery air pressure below said predetermined minimum water pressure.

2. The method of claim 1 wherein said plurality of rooms are further coupled in fluid communication with said corresponding plurality of hot water supply lines by way of a corresponding plurality of pressure sensitive valves, and further comprising the steps of: using said corresponding plurality of pressure sensitive valves for sensing a fluid pressure within said corresponding plurality of hot water supply lines; and performing said step of conveying by said corresponding plurality of pressure sensitive valves opening in response to said corresponding plurality of pressure sensitive valves sensing said fluid pressure dropping below said predetermined minimum water pressure.

3. The method of claim 2 further comprising the step of generating a whistling noise upon said supply of air being conveyed into said plurality of rooms, thereby alerting any occupants that may be in any of said plurality of rooms.

4. The method of claim 1 further comprising the step of maintaining a cold water supply to said plurality of rooms while conveying said supply of air into said plurality of rooms, whereby any occupants that may be in any of said plurality of rooms will have said cold water supply for drinking and available for fire fighting.

5. The method of claim 1 further comprising the step of drawing air into said common hot water supply loop upon sensing said sign of fire, whereby said venting promotes said draining.

6. The method of claim 1 wherein said plurality of rooms are associated with a corresponding plurality of valved room air exhaust vents, and further comprising the step of substantially closing said corresponding plurality of valved room exhaust vents to minimize any influx of smoke into said plurality of rooms.

7. The method of claim 1, further comprising the step of selecting said supply of air from a plurality of sources using a predetermined air quality as a selection criteria.

8. The method of claim 1 wherein said sign of fire is heat.

9. A method of conveying a supply of air to a plurality of rooms upon the presence of a sign of fire, said plurality of rooms each being supplied with heated water above a predetermined minimum water pressure via a corresponding plurality of hot water supply lines that are interconnected by a common hot water supply loop, said plurality of rooms also being coupled in fluid communication with said corresponding plurality of hot water supply lines by way of a corresponding plurality of pressure sensitive valves, said method comprising the steps of:

pumping said heated water in a re-circulating flow pattern through said common hot water supply loop;

sensing a fluid pressure within said corresponding plurality of hot water supply lines, said fluid pressure being sensed by said corresponding plurality of pressure sensitive valves;

sensing said sign of fire;

upon sensing said sign of fire, draining said heated water from said common hot water supply loop, said step of draining being initially assisted by said step of pumping;

maintaining a cold water supply to said plurality of rooms;

injecting said supply of air into said common hot water supply loop;

conveying said supply of air from said common hot water supply loop to said corresponding plurality of hot water supply lines; and opening said corresponding plurality of pressure sensitive valves upon said fluid pressure dropping below said predetermined minimum water pressure, thereby conveying said supply of air from said corresponding plurality of hot water supply lines, through said corresponding plurality of pressure sensitive valves, and into said plurality of rooms.

10. The method of claim 9 further comprising the step of drawing air into said common hot water supply loop upon sensing said sign of fire, whereby said venting promotes said draining.

11. The method of claim 9 wherein said plurality of rooms are associated with a corresponding plurality of valved room air exhaust vents, and further comprising the step of substantially closing said corresponding plurality of valved room air exhaust vents to minimize any influx of smoke into said plurality of rooms.

12. The method of claim 9, further comprising the step of selecting said supply of air from among a plurality of sources using a predetermined air quality as a selection criteria.

13. The method of claim 9 further comprising the step of generating a whistling noise upon said supply of air being conveyed into said plurality of rooms, thereby alerting any occupants that may be in any of said plurality of rooms.

14. The method of claim 9 wherein said sign of fire is heat.

15. A building system responsive to a fire, comprising:

a plurality of rooms;

a corresponding plurality of hot water supply lines;

a common hot water supply loop feeding said corresponding plurality of hot water supply lines with heated water at a fluid pressure exceeding a predetermined minimum water pressure in the absence of said fire;

a plurality of sources each adapted to provide a supply of air;

a compressor coupled to draw said supply of air from at least one of said plurality of sources and deliver said supply of air to said common hot water supply loop at an air pressure below said predetermined minimum water pressure;

a pump in line with said common hot water supply loop;

a sensor providing a signal in response to sensing a characteristic of said fire;

a drain valve coupled to said common hot water supply loop, said drain valve opening in response to said signal; and a plurality of pressure sensitive valves coupling said plurality of hot water supply lines to said plurality of rooms, said plurality of pressure sensitive valves opening in response to sensing said fluid pressure in said corresponding plurality of hot water supply lines dropping below said predetermined minimum water pressure, whereby said signal causes said common hot water supply loop to drain said heated water through said drain valve assisted by said pump, thereby reducing said fluid pressure below said predetermined minimum water pressure to open said plurality of pressure sensitive valves for conveying said supply of air to said plurality of rooms.

16. The building system of claim 15, further comprising a vent valve coupled to said common hot water supply loop, said vent valve opening in response to fluid pressure in said common hot water supply loop dropping below a second predetermined minimum pressure.

17. The building system of claim 15, wherein said characteristic is heat.

18. The building system of claim 15 further comprising a plurality of whistles in series flow relationship with said plurality of pressure sensitive valves, whereby said plurality of whistles provide an audible alarm in the event of a fire.

19. The building system of claim 15 further comprising a plurality of pressure actuated room exhaust vents in fluid communication, and in one-to-one correspondence, with said plurality of rooms, said plurality of pressure actuated room exhaust vents serving to automatically help seal off said plurality of rooms in the event of said fire.

* * * * *